US009777921B2

(12) United States Patent
Takeuchi

(10) Patent No.: US 9,777,921 B2
(45) Date of Patent: Oct. 3, 2017

(54) COMBUSTION PLATE

(71) Applicant: RINNAI CORPORATION, Nagoya-shi, Aichi (JP)

(72) Inventor: Masaru Takeuchi, Aichi (JP)

(73) Assignee: RINNAI CORPORATION, Nagoya-Shi (JP)

( * ) Notice: Subject to any disclaimer, the term of this patent is extended or adjusted under 35 U.S.C. 154(b) by 388 days.

(21) Appl. No.: 14/561,382

(22) Filed: Dec. 5, 2014

(65) Prior Publication Data

US 2016/0161113 A1 Jun. 9, 2016

(51) Int. Cl.

| | |
|---|---|
| ***F23D 14/14*** | (2006.01) |
| ***F23D 14/56*** | (2006.01) |
| ***F23D 14/58*** | (2006.01) |
| ***F23D 14/02*** | (2006.01) |

(52) U.S. Cl.

CPC ..... *F23D 14/14* (2013.01); *F23D 14/02* (2013.01); *F23D 14/56* (2013.01); *F23D 14/58* (2013.01); *F23D 2212/10* (2013.01); *F23D 2900/00012* (2013.01); *F23D 2900/11402* (2013.01)

(58) Field of Classification Search

CPC ..... F23D 14/14; F23D 14/56; F23D 14/58; F23D 14/02; F23D 2900/11402; F23D 2212/10; F23D 2900/00012

See application file for complete search history.

(56) References Cited

U.S. PATENT DOCUMENTS 4,063,873 A * 12/1977 Naito ..... F23D 14/14 431/328
5,957,682 A * 9/1999 Kamal ..... F23D 14/36 431/115

FOREIGN PATENT DOCUMENTS

| | | |
|---|---|---|
| JP | 63-134221 U | 9/1988 |
| JP | 1-129531 U | 9/1989 |
| JP | 06-147434 | 5/1994 |
| JP | 06-147435 | 5/1994 |
| JP | 9-42616 | 2/1997 |

OTHER PUBLICATIONS

Japanese Office Action with English Machine Translation dated May 10, 2016, 4 pages.

* cited by examiner

*Primary Examiner* — Alfred Basichas
(74) *Attorney, Agent, or Firm* — Rankin, Hill & Clark LLP

(57) ABSTRACT

A plate body 11 of a combustion plate 10 is provided with no-burner port portion 13 where no burner ports 12 exist, and a burner port group 14 made up of a plurality of burner ports 12 is arranged in each region 15 of the plate body 11 surrounded by the no-burner port portion 13. A port diameter D of the burner ports 12 differs between the burner port groups 14, but the respective burner port groups 14 are made up of the burner ports 12 of the same port diameter D, and are arranged so that the greater the port diameter D of the burner ports 12 making up each burner port group 14, the greater the interval T between the burner ports 12 in the burner port group 14 becomes.

5 Claims, 3 Drawing Sheets

COMBUSTION PLATE

BACKGROUND OF THE INVENTION

Field of the Invention

The present invention relates to a combustion plate, and more particularly, to a combustion plate with many burner ports formed in the plate body.

Description of the Related Arts

Conventionally, combustion plates with many burner ports formed in a ceramic plate body are used for all primary combustion system type burners provided for heat source equipment for hot water supply, heating or the like.

Various efforts are made in this type of combustion plate to suppress resonance of flames and reduce noise.

For example, Japanese Patent Laid-Open No. 6-147434 describes a combustion plate with many large, medium and small burner ports arranged such that one large burner port is placed at a center of four neighboring small burner ports and each small burner port is placed at a center of four medium burner ports. In this combustion plate, flames of the large burner port with large vibration energy are attenuated by interference of flames of medium burner ports with a medium frequency and vibration energy. Similarly, vibration energy of flames with medium burner ports is attenuated by interference of flames of small burner ports.

Furthermore, Japanese Patent Laid-Open No. 6-147435 describes a combustion plate in which many small burner ports are divided into a main flame group that forms main flames, a first pilot flame group that forms a small pilot flame group around the main flames, and a second pilot flame group that forms a pilot flame array that surrounds each main flame and the first pilot flame group. In this combustion plate, the number of burner ports differs from one burner port group to another, which causes a resonance frequency of flames to differ from one burner port group to another, preventing combustion resonance from occurring.

However, in the combustion plate described in above Japanese Patent Laid-Open No. 6-147434, heat is likely to concentrate on the large burner port and backfire is likely to occur.

In the combustion plate described in above Japanese Patent Laid-Open No.6-147435, flames are likely to resonate in a situation in which flames are formed in individual burner ports instead of set flames of each group.

The present invention has been implemented in view of such a background, and it is an object of the present invention to provide a combustion plate capable of preventing resonance of flames and backfire.

SUMMARY OF THE INVENTION

The present invention has been implemented to attain the above described object and the present invention is a combustion plate with a plurality of burner ports that jet out combustion gas formed in a plate body, in which the plate body comprises a no-burner port portion where no burner ports exist, a burner port group formed of a plurality of burner ports is arranged in each region of the plate body surrounded by the no burner port portion, port diameters of the burner ports differ between the burner port groups while each of the burner port groups is made up of the burner ports having the same port diameter, and the burner ports are arranged such that the greater the port diameter of the burner ports making up each burner port group, the greater an interval between the burner ports in the burner port group becomes.

Since the present invention includes a plurality of burner port groups made up of burner ports having different port diameters, a natural frequency of flames produced by combustion of each burner port group differs from one burner port group to another, and it is thereby possible to prevent resonance caused by interference of flames Moreover, since a greater interval is provided for burner ports of a greater port diameter where backfire is more likely to occur, it is possible to prevent overheat of the surface of the combustion plate between burner ports and thereby prevent the occurrence of backfire.

In the present invention, the no-burner port portion is preferably provided in a grid shape and the burner ports making up the burner port group preferably have different port diameters between the burner port groups neighboring each other across the no-burner port portion forming a grid-shaped sides.

In this case, it is possible to more effectively prevent resonance caused by interference of flames.

In the present invention, it is preferable that at a time of maximum combustion, a total resistance when the combustion gas passes through each burner port composing the burner port group is identical in each of the burner port groups.

In this case, since the total passage resistance of the combustion gas of each burner port group is identical at the time of maximum combustion, it is possible to equalize the jet quantity of the combustion gas as a collective burner port of each burner port group. This equalizes the heights of flames of each burner port group, and even when a compact burner is introduced, it is possible to prevent problems of insufficient combustion caused by only long flames touching a heat exchanger or the like.

DETAILED DESCRIPTION OF THE PREFERRED EMBODIMENT

A combustion apparatus 20 provided with a combustion plate 10 according to an embodiment of the present invention will be described.

Figure 1:
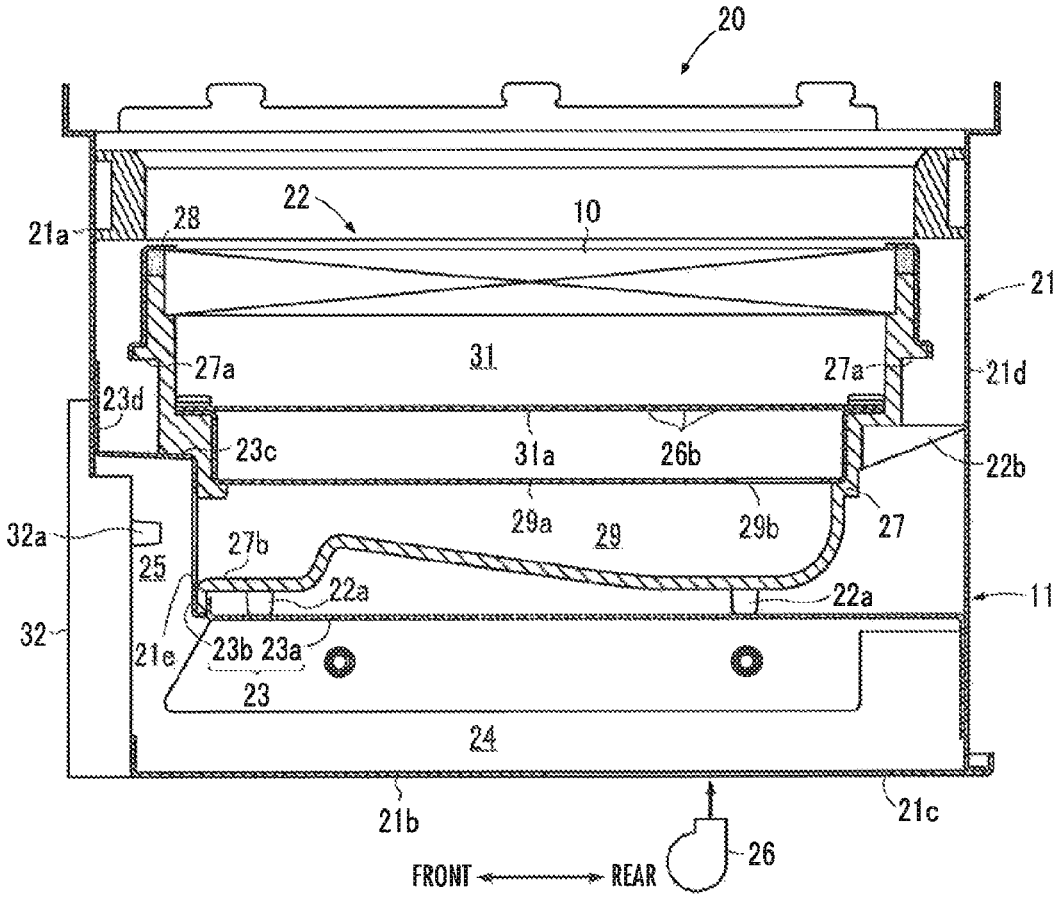
FIG. 1 is a cross-sectional view of a combustion apparatus provided with a combustion plate according to an embodiment of the present invention.

Referring to FIG. 1, the combustion apparatus 20 comprises a combustion case 21, on top of which a heating target such as a heat exchanger for hot water supply (not shown) is placed and a all primary combustion system type burner 22 placed in the combustion case 21.

Though not shown, flame detection elements such as an ignition plug and a frame rod are provided on a front plate 21*a* of the combustion case 21. A lower air chamber 24 partitioned by a partition plate 23 from a part in which the burner 22 is placed is provided in the combustion case 21.

The partition plate 23 is constructed of a lower plate part 23*a* that supports the burner 22 and a front plate part 23*b* attached to the lower front surface of the burner 22 and also serving as a damper to demarcate a primary air chamber 25 that rises from the front of the air chamber 24. An eaves 23*c* bent frontward to serve as a top surface of the primary air chamber 25 and a flange part 23*d* bent upward from a front end of the eaves 23*c* and connected to a rear lower part of the front plate 21*a*, are formed at a top end of the front plate part 23*b*.

A connection port 21*c* for connecting an air duct of a combustion fan 26 is opened in a base plate 21*b* of the combustion case 21 configured so that air from the combustion fan 26 flows into the air chamber 24.

The burner 22 comprises a box-shaped burner body 27 from which an undersurface leg part 22*a* seated on the lower plate part 23*a* of the partition plate 23 and a rear surface spacer part 22*b* that abuts a rear plate 21*d* of the combustion case 21, are projected. A ceramic combustion plate 10 having many burner ports 12 (see FIG. 2) is attached to an upper surface of the burner body 27. Thus, the burner 22 is configured as a plate-shaped burner.

Here, the combustion plate 10 is fixed to the burner body 27, using a pressing frame 28 as a stopper which abuts a top surface periphery thereof from above. A flange part 27*a* is located so as to protrude below the combustion plate 10 over whole periphery of an outer surface of the burner body 27 and the pressing frame 28 is fixed to this flange part 27*a*.

An inflow port 27*b* is opened at a front lower part of the burner body 27, which communicates with the primary air chamber 25 via an opening 21*e* formed in the front plate part 23*b* of the partition plate 23 attached to the burner body 27.

A lower mixing chamber 29 that extends rearward from the inflow port 27*b* and an upper distribution chamber 31 that communicates with the mixing chamber 29 via an opening 29*b* formed at a back of the top surface plate 29*a* of the mixing chamber 29 are provided in the burner body 27. A distribution plate 31*a* that divides the distribution chamber 31 into two portions: upper and lower chambers, is provided in the distribution chamber 31, and many distribution ports are formed in the distribution plate 31*a* so that a pressure distribution of a portion of the distribution chamber 31 between the combustion plate 10 and the distribution plate 31*a* becomes uniform.

A front of the primary air chamber 25 is closed by a gas manifold 32 and this gas manifold 32 comprises a gas nozzle 32*a* that faces the inflow port 27*b*. As such, primary air from the primary air chamber 25 together with a fuel gas from the gas nozzle 32*a* flows into the mixing chamber 29 of the burner 22, the fuel gas and the primary air are mixed in the mixing chamber 29, an air-fuel mixture whose fuel gas concentration is leaner than a theoretical air-to-fuel ratio is generated, and this air-fuel mixture jets out from the burner ports of the combustion plate 10 via the distribution chamber 31 and is burned in totally aerated combustion.

Figure 2:
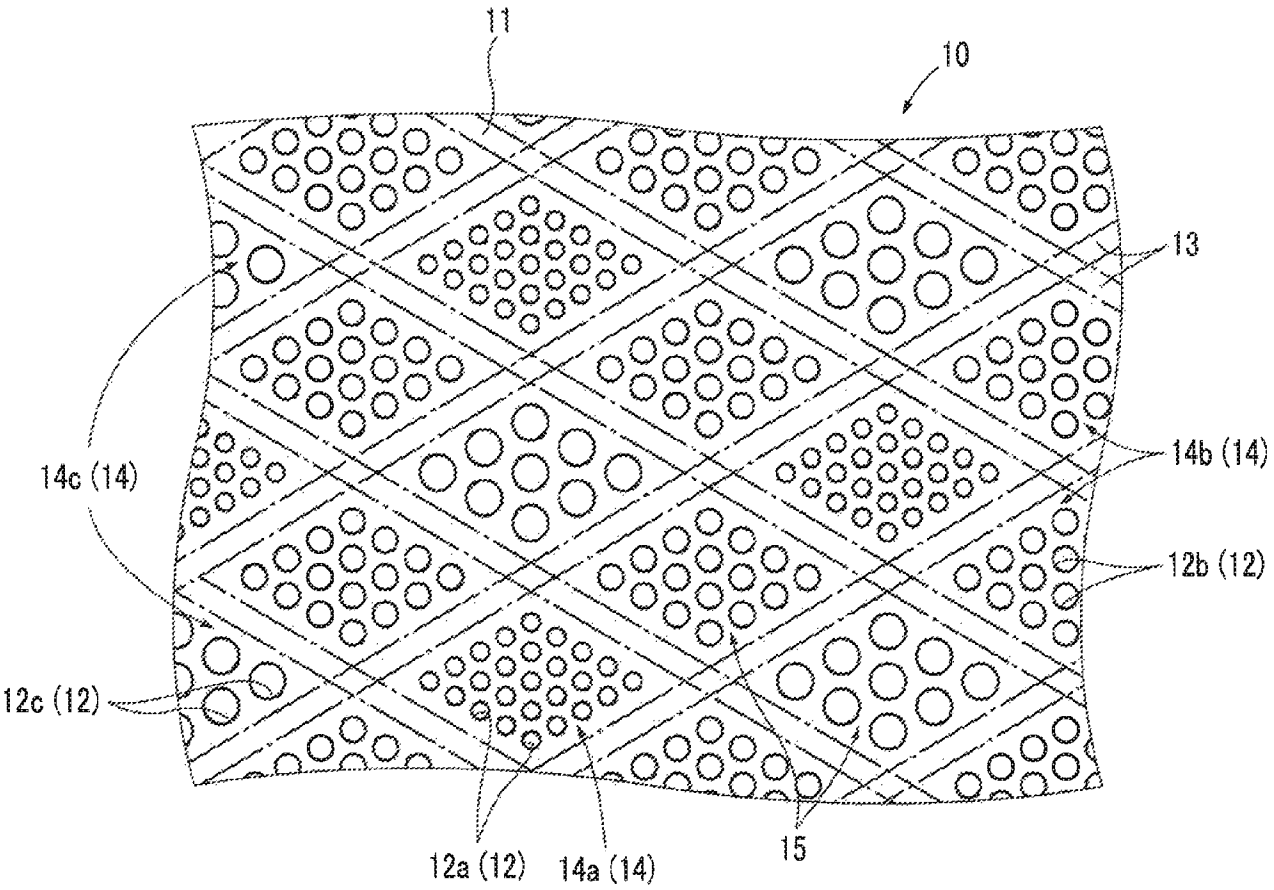
FIG. 2 is a top view illustrating part of the combustion plate.

Hereinafter, the combustion plate 10 will be described. Referring to FIG. 2, the combustion plate 10 is made up of a ceramic plate body 11 in which many burner ports 12 are formed and combustion gas (pre-mixed gas) jets out from these burner ports 12 and is burned in totally aerated combustion. Note that for simplicity, burner ports 12 are not shown in FIG. 1.

The plate body 11 is composed of no-burner port portions 13 provided in a grid shape without any burner ports 12 and, and regions 15 surrounded by the no-burner port portions 13 and displaced with a burner port group 14 made up of a plurality of burner ports 12. Here, the no-burner port portions 13 have a rhomboid grid shape and each region 15 has a rhomboid shape.

The burner port group 14 made up of the plurality of burner ports 12 of the same port diameter D is arranged in each region 15. The port diameter D of the burner ports 12 making up the burner port group 14 differs between the neighboring burner port groups 14 across the no-burner port portions 13 that forms the grid-shaped sides.

Figure 3A:
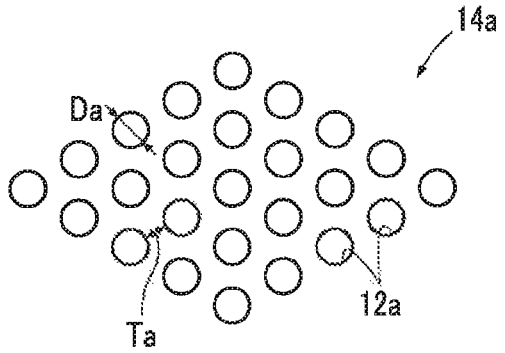
FIG. 3A is a top view illustrating a small burner port group.
Figure 3B:
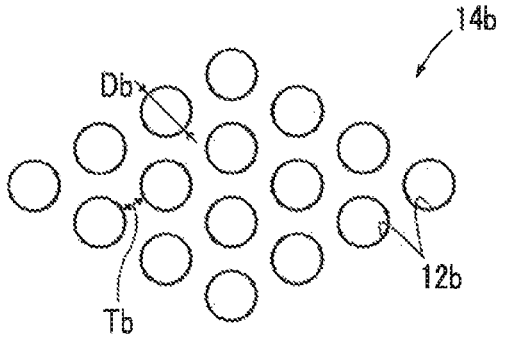
FIG. 3B is a top view illustrating a medium burner port group and FIG. 3C is a top view illustrating a large burner port group.
Figure 3C:
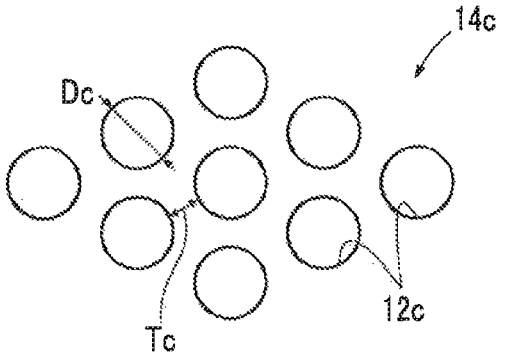

Here, the burner port group 14 is classified into three burner port groups 14*a*, 14*b* and 14*c*. Referring to FIG. 3A to FIG. 3C, a port diameter Da of small burner ports 12*a* belonging to a small burner port group 14*a*, a port diameter Db of medium burner ports 12*b* belonging to a medium burner port group 14*b*, and a port diameter Dc of large burner ports 12*c* belonging to a large burner port group 14*c*, have a relationship of Da<Db<Dc. An interval Ta between the small burner ports 12*a* belonging to the small burner port group 14*a*, an interval Tb between the medium burner ports 12*b* belonging to the medium burner port group 14*b*, and an interval Tc between the large burner ports 12*c* belonging to the large burner port group 14*c*, have a relationship of Ta<Tb<Tc.

Accordingly, Na as the number of the small burner ports 12*a* belonging to the small burner port group 14*a*, Nb as the number of the medium burner ports 12*b* belonging to the medium burner port group 14*b*, and Nc as the number of the large burner ports 12*c* belonging to the large burner port group 14*c*, have a relationship of Na>Nb>Nc. Note that an interval T means a minimum distance of a region existing between the burner ports 12 where no burner ports 12 are formed.

As an example, the port diameter Da of the small burner ports 12*a* is 1.00 mm, the interval Ta between the small burner ports 12*a* is 1.00 mm and the Na as the number of the small burner ports 12*a* belonging to the small burner port group 14*a* is 25, the port diameter Db of the medium burner ports 12*b* is 1.25 mm, the interval Tb between the medium burner ports 12*b* is 1.25 mm, and the Nb as the number of the medium burner ports 12*b* belonging to the medium burner port group 14*b* is 16, and the port diameter Dc of the large burner ports 12*c* is 1.67 mm, the interval Tc between the large burner ports 12*c* is 1.67 mm, and the Nc as the number of the large burner ports 12*c* belonging to the large burner port group 14*c* is 9. The width of the no-burner port portion 13 is 2 mm Although a case has been taken as an example where all the intervals T between the burner ports 12 belonging to the same burner port group 14 are identical, the present invention is not limited. It is only required that a maximum interval between the small burner ports 12*a* belonging to the small burner port group 14*a* is smaller than a minimum interval between the medium burner ports 12*b* belonging to the medium burner port group 14*b*, and a maximum interval between the medium burner ports 12*b* belonging to the medium burner port group 14*b* is smaller than a minimum interval between the large burner ports 12*c* belonging to the large burner port group 14*c*.

According to the present embodiment, the combustion plate 10 has three burner port groups 14 (14*a*, 14*b* and 14*c*) made up of burner ports 12 having different port diameters D. Thus, since a natural frequency of flames formed of a collective burner port made up of the respective burner port groups 14 varies, it is possible to prevent resonance caused by interference there between and it is also possible to prevent resonance caused by interference of flames in a state in which flames are formed at individual burner ports 12 of the respective burner port groups 14.

Since a greater interval T between the burner ports 12 is provided for the burner ports 12 having a large port diameter D in which backfire is more likely to occur, it is possible to prevent backfire from occurring. To put it more specifically, the small burner ports 12*a* having a small interval Ta become red hot first and passage resistance of the small burner ports 12*a* increases. As a result, the amount of combustion gas passing through the large burner ports 12*c* increases, which causes the jetting speed to increase, and thereby causes a surface temperature of the combustion plate 10 to decrease, making it less likely for the large burner ports 12*c* to become red hot, and thereby making it possible to prevent backfire from occurring in the large burner ports 12*c*.

Moreover, the port diameter D of each burner port 12 and N as the number of burner ports 12 composing the burner port group 14 are preferably determined so that at the time of maximum combustion, the total resistance when the combustion gas passes through each burner port 12 composing the burner port group 14 is identical among the respective burner port groups 14. This equalizes the height of a collective flame formed at each burner port group 14, and makes it possible to prevent problems of insufficient combustion caused by only long flames touching a heat exchanger or the like.

Note that the total resistance of the respective burner port groups 14 need not be exactly the same, but may be within a range settable by those skilled in the art to a limit that no insufficient combustion would occur by an experiment or simulation or the like. To equalize the total resistance, the back surface of the combustion plate 10 may be cut to adjust the lengths of the burner ports 12.

The embodiment of the present invention has been described so far with reference to the accompanying drawings, but the present invention is not limited to this. For example, in the aforementioned embodiment, the no-burner port portion 13 has a rhomboid grid shape and each region 15 has a rhomboid shape. However, the grid shape of the no-burner port portion 13 is not limited to the rhomboid shape, but may be a triangular, rectangular or hexagonal shape.

In the embodiment, the burner port group 14 is classified into three types. However, the burner port group 14 needs only to differ between neighboring burner port groups 14 across the no-burner port portion 13 forming the grid-shaped sides and may be classified into two or four or more types. Note that the number of types into which the burner port group 14 is classified varies depending on the aforementioned grid shape of the no-burner port portion 13. For example, when the grid shape of the aforementioned no-burner port portion 13 is hexagonal, the burner port group 14 needs to be classified into a minimum of three types.

Furthermore, the present invention is not limited to the case where burner port groups 14 varies between the neighboring burner port groups 14 across the no-burner port portions 13 forming the grid-shaped sides, but the burner port groups 14 may be identical. However, when the burner port groups 14 are identical, the effect of preventing resonance caused by interference of flames is reduced.

What is claimed is:

1. A combustion plate comprising a plurality of burner ports that jet out combustion gas formed in a plate body, wherein the plate body comprises a no-burner port portion where no burner ports exist, the no-burner port portion surrounding a plurality of regions of the plate body, a burner port group composed of a plurality of burner ports is arranged in each of the plurality of regions of the plate body surrounded by the no-burner port portion, port diameters of burner ports differ between burner port groups, and each burner port group is made up of burner ports having the same port diameter, the burner ports are arranged such that the greater the port diameter of the burner ports making up each burner port group, the greater an interval between the burner ports in the burner port group, and the burner ports are configured so that, at a time of maximum combustion, a total resistance when the combustion gas passes through each burner port making up the burner port groups is identical among the burner port groups.

2. The combustion plate according to claim 1, wherein the no-burner port portion is provided in a grid shape and the burner ports making up the burner port group have different diameters between the burner port groups neighboring each other across the no-burner port portion forming a grid-shaped sides.

3. The combustion plate according to claim 1, wherein, at the time of maximum combustion, a collective flame is formed at each burner port group.

4. The combustion plate according to claim 1, wherein the port diameter and a number of burner ports in each burner port group is set so that the total resistance is identical among the burner port groups at the time of maximum combustion.

5. The combustion plate according to claim 4, wherein, at the time of maximum combustion, a collective flame is formed at each burner port group.

* * * * *